US011380293B2

(12) United States Patent
Hietkamp et al.

(10) Patent No.: US 11,380,293 B2
(45) Date of Patent: Jul. 5, 2022

(54) PERCUSSION INSTRUMENT

(71) Applicants: Wouter Gerrit Hietkamp, Utrecht (NL); Gerrit Willem Hietkamp, Leiden (NL)

(72) Inventors: Wouter Gerrit Hietkamp, Utrecht (NL); Gerrit Willem Hietkamp, Leiden (NL)

( * ) Notice: Subject to any disclaimer, the term of this patent is extended or adjusted under 35 U.S.C. 154(b) by 403 days.

(21) Appl. No.: 16/629,350

(22) PCT Filed: Jul. 3, 2018

(86) PCT No.: PCT/NL2018/050431

§ 371 (c)(1),
(2) Date: Jan. 8, 2020

(87) PCT Pub. No.: WO2019/017771

PCT Pub. Date: Jan. 24, 2019

(65) Prior Publication Data

US 2021/0142769 A1 May 13, 2021

(30) Foreign Application Priority Data

Jul. 18, 2017 (NL) ..... 2019269

(51) Int. Cl.
*G10D 13/16* (2020.01)
*G10D 13/20* (2020.01)
*G10D 13/02* (2020.01)

(52) U.S. Cl.
CPC ..... *G10D 13/16* (2020.02); *G10D 13/02* (2013.01); *G10D 13/20* (2020.02)

(58) Field of Classification Search
CPC ..... G10D 13/16; G10D 13/20; G10D 13/02
See application file for complete search history.

(56) References Cited

U.S. PATENT DOCUMENTS 1,595,451 A * 8/1926 Cole ..... G10D 13/16 84/411 R
2,051,671 A 8/1936 Au-miller
(Continued)

FOREIGN PATENT DOCUMENTS

| | | | |
|---|---|---|---|
| DE | 34594 | C | 6/1885 |
| GB | 593016 | A | 10/1947 |
| WO | 2017221278 | A1 | 12/2017 |

OTHER PUBLICATIONS

International Search Report and Written Opinion for the International Patent Application No. PCT/NL/2018/050431, dated Nov. 21, 2018, 19 pages.

(Continued)

*Primary Examiner* — Robert W Horn
(74) *Attorney, Agent, or Firm* — KDB Firm PLLC

(57) ABSTRACT

A percussion instrument includes a drum head arranged on a support with a flange of the drum head extending from the support, wherein the support is an inner ring, and an outer ring comprising an abutment that is configured to engage the flange of the drum head. The inner ring and the outer ring are concentrically arranged and moveable relative to each other in a longitudinal direction. The percussion instrument also includes a tensioning mechanism having an external screw thread going around on an outer circumference of the inner ring, and an internal screw thread going around on an inner circumference of the outer ring.

12 Claims, 7 Drawing Sheets

(56) References Cited

U.S. PATENT DOCUMENTS

| | | | | |
|---|---|---|---|---|
| 2,061,244 | A | 11/1936 | Au-miller | |
| 2,173,443 | A * | 9/1939 | Schuman | G10D 13/16 84/411 R |
| 2,425,996 | A * | 8/1947 | Cordes | G10D 13/16 84/411 R |
| 3,439,573 | A * | 4/1969 | Zottolo | G10D 13/16 84/411 R |
| 4,079,657 | A * | 3/1978 | Sobreira | G10D 13/16 84/411 R |
| 4,218,952 | A | 8/1980 | Arbiter | |
| 5,739,448 | A * | 4/1998 | Toscano | G10D 13/02 84/411 R |
| 7,501,567 | B1 * | 3/2009 | Spinazzola | G10D 13/16 84/411 R |
| 7,888,575 | B1 * | 2/2011 | Toscano | G10D 13/02 84/413 |
| 8,642,867 | B1 * | 2/2014 | Bedson | G10D 13/16 84/413 |
| 9,006,548 | B2 * | 4/2015 | Bedson | G10D 13/02 84/413 |
| 9,349,355 | B2 * | 5/2016 | Jones | G10D 13/16 |
| 9,613,602 | B2 * | 4/2017 | Welch | G10D 13/16 |
| 10,714,062 | B2 * | 7/2020 | Welch | G10D 13/20 |
| 10,720,130 | B2 * | 7/2020 | Shenhar | G10D 13/16 |
| 2009/0064844 | A1 | 3/2009 | O'Connor | |
| 2014/0026732 | A1 | 1/2014 | Spinazzola | |
| 2021/0142769 | A1 * | 5/2021 | Hietkamp | G10D 13/20 |

OTHER PUBLICATIONS

International Preliminary Report on Patentability for the International Patent Application No. PCT/NL2018/050431, dated Sep. 24, 2019, 8 pages.

* cited by examiner

PERCUSSION INSTRUMENT

This is a national stage application filed under 35 U.S.C. § 371 of pending international application PCT/NL2018/050431, filed Jul. 3, 2018, which claims priority to Netherlands Patent application NL 2019269, filed Jul. 18, 2017, the entirety of which applications are hereby incorporated by reference herein.

The present invention relates to a percussion instrument, comprising a drum head that is arranged on a support with a flange of the drum head extending from the support, and a tensioning mechanism.

Conventional percussion instruments, such as drums, also comprise a drum head that is arranged on a support with a flange of the drum head extending from the support. Using a tensioning mechanism that comprises multiple independent tensioning rods arranged around the circumference of the drum, the drum head is tensioned.

Replacing and tuning of a drum head comprises the steps of diagonally loosening the tensioning rods by a limited turn at once, until they are loose and the drum head may be removed. The tensioning rods engage drum lugs that are arranged on the side of a drum (and a counter hoop (drum hoop).

After a new drum head is arranged on the support, a rim (drum hoop) and the tensioning rods are placed back onto the drum. Then, all tensioning rods are evenly tightened and gradually tightened in a diagonal pattern, each time tensioning a specific rod a little bit further. When a specific tensioning rod is tightened, it locally increases the tension on the drum head and thereby increases the pitch of the percussion instrument at a specific spot. A uniform pitch, meaning that the pitch is substantially independent of the location where the drum head is struck, is only achieved if all tensioning rods substantially cause a similar tension in the drum head. Obtaining a uniform tension is a laborious process, especially because tightening a specific tensioning rod also influences the tension at other positions of the drum head. Obtaining the desired pitch in combination with a uniform tension is even more difficult.

U.S. Pat. No. 3,439,573 is considered the closest prior art, relative to which at least the characterizing features of claim 1 are novel. It discloses a drum tuning device, wherein the tension in the drum head can be controlled by moving the ring up or down, axially along a shell of the percussion instrument. In order to do so, a user turns a control knob, thereby moving corresponding gears and racks. Using this control knob, the drum head may be tensioned, requiring a large gear ratio between the pinion and the tensioning ring. As a result of this large gear ratio, a user has to turn the control knob for a very high number of turns if the percussion drum has to be taken apart to exchange a drum head. This is a time consuming and laborious process.

U.S. Pat. No. 2,425,996 discloses a percussion drum having a shell with a reduced end portion having a ring with an external thread. A retaining hoop having an internal thread is screwed at its inner portion upon the threaded ring so as to be adjustable longitudinally of the shell, and this retaining hoop has an annular inwardly projecting flange at its outer end. A tensioning ring is threaded in the outer portion of the retaining hoop and has its outer periphery provided with external gear teeth so that is also constitutes a ring gear. A pinion meshes with the teeth of the tensioning ring. Using this pinion, the drum head may be tensioned, again requiring a large gear ratio between the pinion and the tensioning ring. Consequently, a user has to turn the pinion for a very high number of turns if the percussion drum has to be taken apart to exchange a drum head, resulting again in a time consuming and laborious process.

The drum tuning device of US 2009/064844 have the same disadvantage of having to rotate the control wheel for a very high number of turns if the percussion drum has to be taken apart to exchange a drum head.

U.S. Pat. No. 4,218,952 is acknowledged as further prior art.

An object of the present invention is to provide a percussion element, that is improved relative to the prior art and provides improved tuning.

Said object is achieved with the percussion instrument according to claim 1 of the present invention, comprising:

- a drum head arranged on a support with a flange of the drum head extending from the support, wherein the support is an inner ring;
- an outer ring comprising an abutment that is configured to engage the flange of the drum head;
- wherein the inner ring and the outer ring are concentrically arranged and moveable relative to each other in a longitudinal direction; an
- a tensioning mechanism, comprising:
  - an external screw thread going round on an outer circumference of the inner ring; and
  - an internal screw thread going round on an inner circumference of the outer ring.

The external screw thread going round on the outer circumference of the inner ring and the mating internal screw thread going round on the inner circumference of the outer ring allow the inner and outer ring to be rotated relative to each other manually. Manually, using bare hands, it is possible to fast and conveniently turn the rings and displace them relative to each other in the longitudinal direction, i.e. the axial direction. Contrary to the drum tuning device of U.S. Pat. No. 3,439,573, it is not necessary to turn a control wheel to move the inner and outer ring over a large distance, which takes considerable time and effort due to a large gear ratio that exists between the control wheel and the adjustment or the rings relative to each other.

Moreover, the percussion instrument according to the invention is relatively simple and therefore robust and easy to manufacture. The tensioning mechanism only comprises two rings, i.e. the inner ring and the outer ring, whereas the prior art mentioned above proposes constructions with a plurality of different parts, also including ball bearings. Therefore, the percussion element according to the invention is significantly easier to assemble and manufacture than the prior art percussion elements. Moreover, the tensioning mechanism being constructed of only two rings results in a robust and reliable tensioning mechanism.

According to a preferred embodiment, the percussion instrument further comprises a tensioning mechanism having single actuator instead of the multiple independently and successively adjusted tensioning rods as applied in conventional percussion instruments.

Relative to the drum tuning device of U.S. Pat. No. 3,439,573, the single actuator may be used for fine tuning only, after the inner ring and outer ring being turned over a large longitudinal distance manually. Due to the large gear ratio, the single actuator allows for precise fine tuning and is able to apply larger forces than may be applied manually by hand force only.

The single actuator is thus, one the one hand, configured to tune a pitch of the percussion instrument by operating said single actuator. On the other hand, the single actuator is configured to—simultaneously with said tuning of the pitch—maintain uniform tension of the drum head around a circumference of the support.

Providing an inner ring with an external screw thread going round on the outer circumference thereof, and an outer ring having an internal screw thread going round on the inner circumference of the outer ring, allows for a simple design with minimal parts. Moreover, these parts, especially the inner ring and the outer ring, may be 3D-printed, thereby obtaining the option to e.g. vary a wall thickness of the support along a longitudinal direction thereof. 3D printing also allows at least one of the support and the tensioning mechanism to be made from a transparent or semi-transparent material, thereby providing the option to illuminate the device elegantly. Such illumination may be used for educational purposes, e.g. for indicating a drum rhythm.

Further preferred embodiments are the subject of the dependent claims.

The invention also relates to a computer-readable medium having computer-executable instructions adapted to cause a 3D printer to, when executing the instructions, print a percussion element according to the invention.

In the following description preferred embodiments of the present invention are further elucidated with reference to the drawing, in which.

Figure 1:
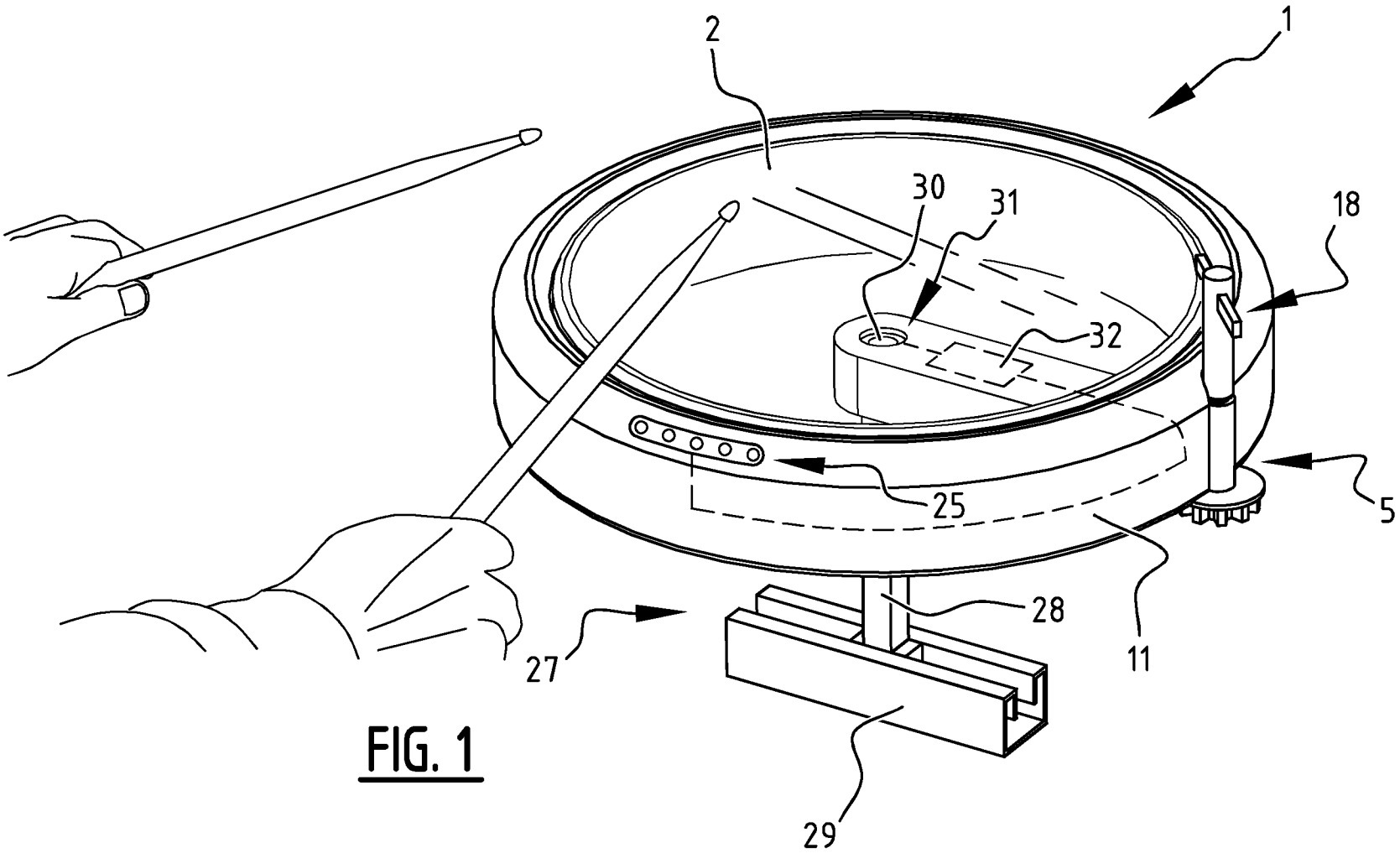
FIG. 1 is a perspective view of a percussion instrument according to the invention, during tuning thereof.
Figure 2:
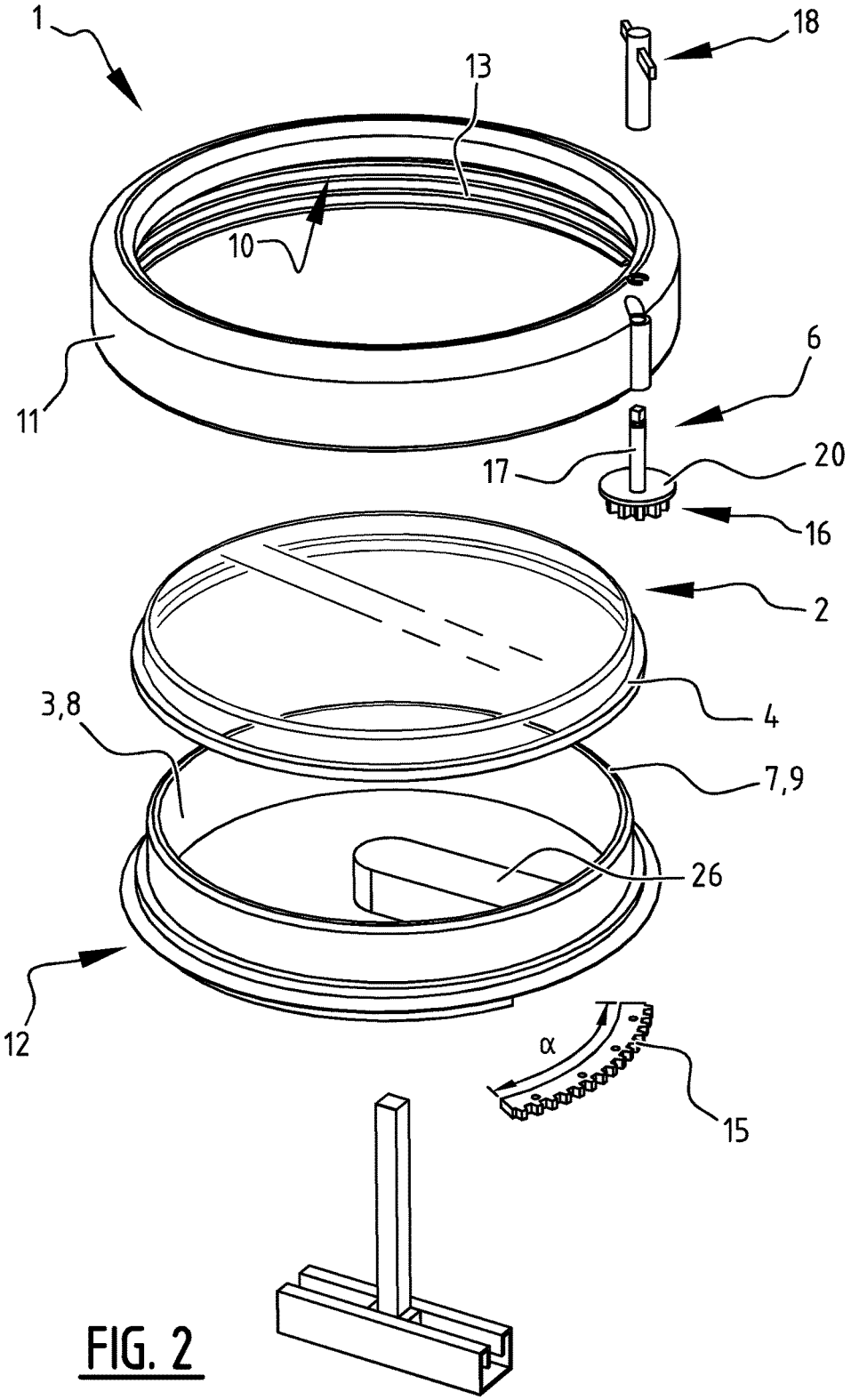
FIG. 2 is an exploded perspective view of the percussion instrument of FIG. 1.
Figure 3:
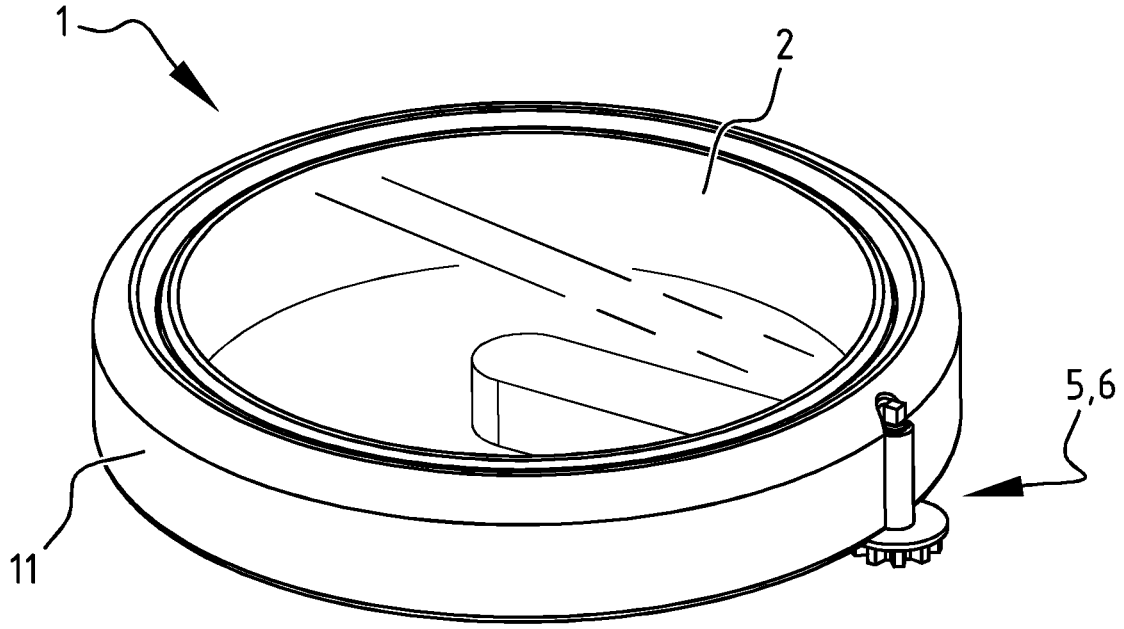
FIGS. 3 and 4 are perspective views of an assembled percussion instrument according to FIG. 1, respectively seen from above and from below.
Figure 4:
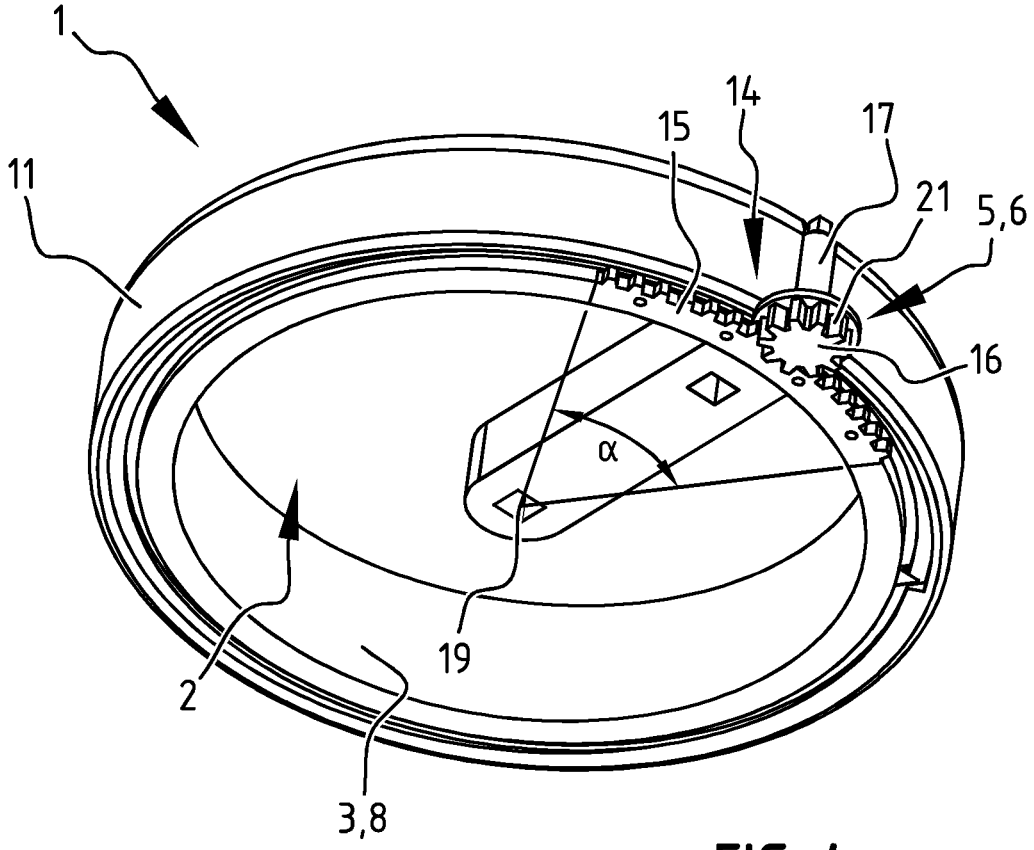
Figure 5:
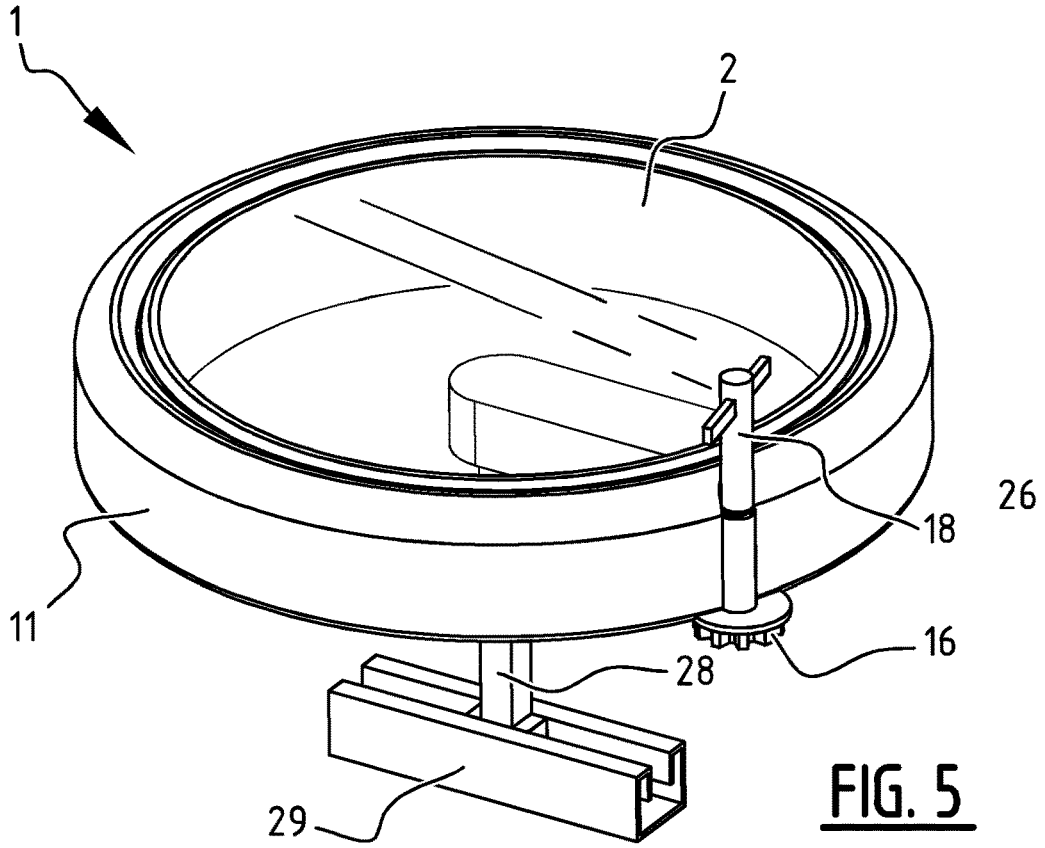
Figure 6:
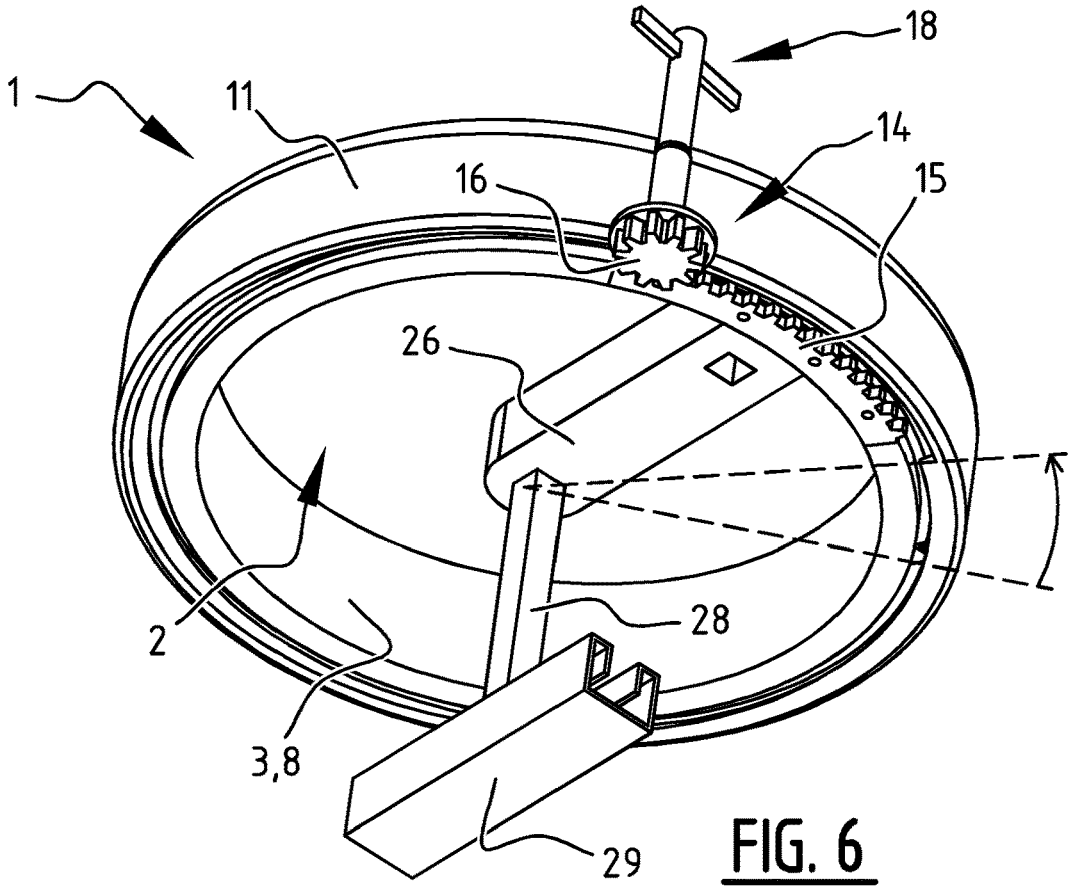
Figure 7:
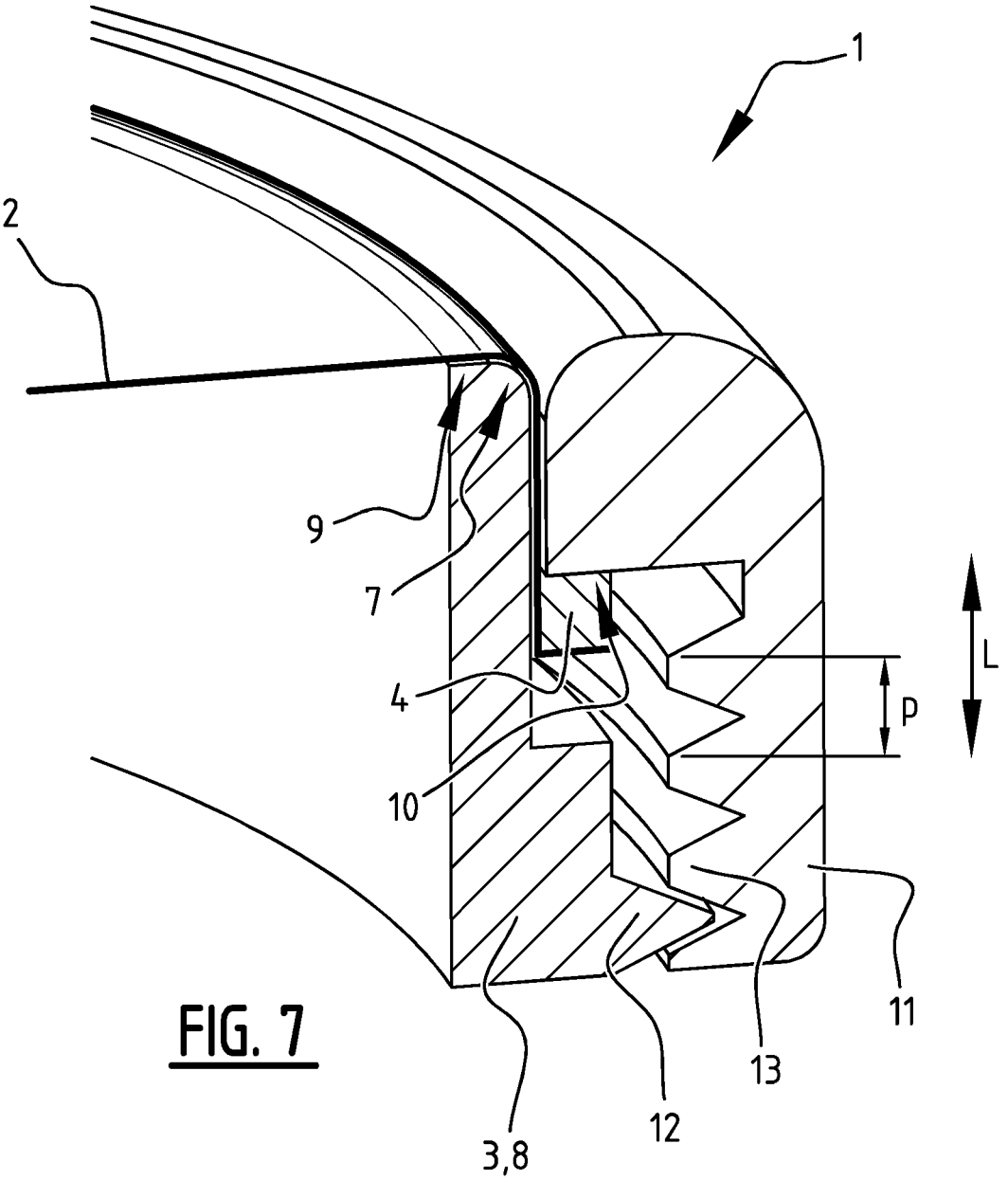
Figure 8:
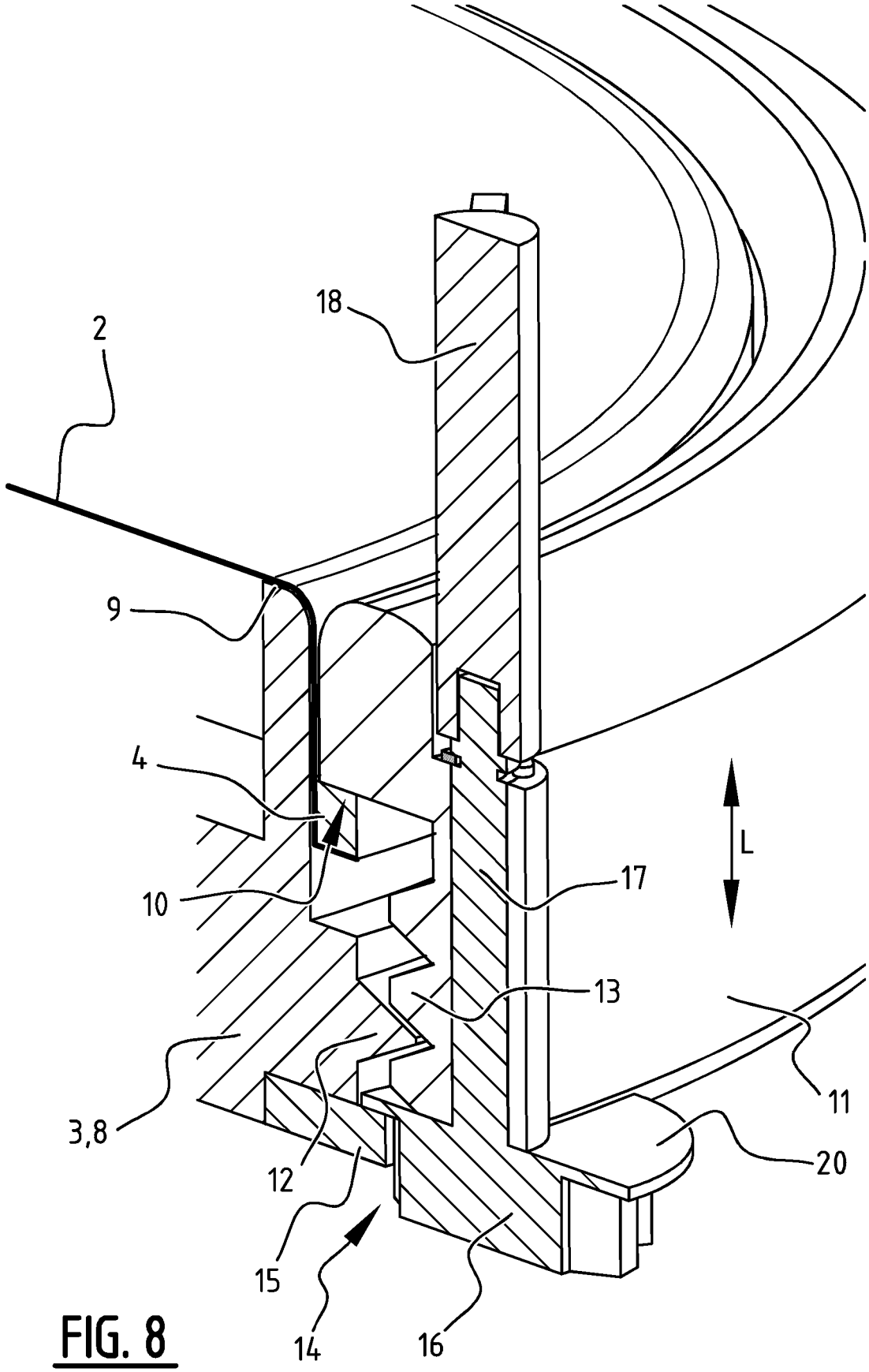
Figure 9:
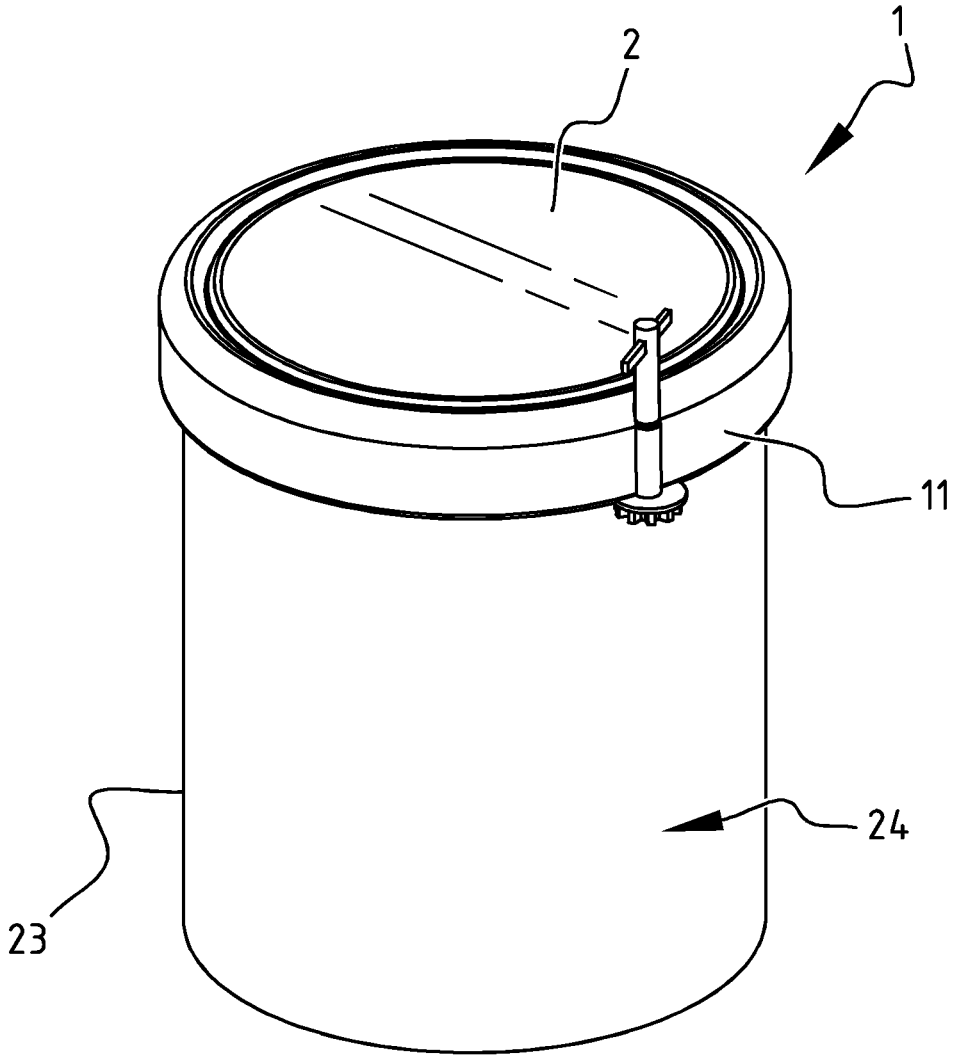

FIGS. 5 and 6 are perspective views corresponding to the orientation in FIGS. 3 and 4, during tuning of said percussion instrument; and FIGS. 7 and 8 are perspective cross sectional views of the percussion instrument according to FIG. 1; and FIG. 9: a further embodiment of a conventional percussion instrument that is provided with a tensioning mechanism 5 according to the invention.

The percussion instrument 1 shown in the Figures, comprises a drum head 2 that is arranged on a support 3 with a flange 4 of the drum head 2 extending from the support 3. It further comprises a tensioning mechanism 5 having a single actuator 6, configured to simultaneously tune a pitch of the percussion instrument 1 by operating the single actuator 6 and maintain uniform tension of the drum head 2 around a circumference 7 of the support 3.

In the shown embodiment, the support 3 is an inner ring 8 and the circumference 7 thereof comprises a bearing edge 9.

The tensioning mechanism 5 comprises an abutment 10 that is configured to engage the flange 4 of the drum head 2. The abutment 10 is arranged on an outer ring 11. If the abutment 10 is itself ring shaped, it will provide an evenly distributed engagement with the flange 4, contributing to an optimal distributed tension of the drum head 2.

The inner ring 8 and the outer ring 11 are concentrically arranged and are moveable relative to each other in a longitudinal direction L. When the inner ring 8 and the outer ring 11 move relative to each other in the longitudinal direction L, the abutment 10 of the outer ring 11 will move the flange 4 of the drum head 2 relative to the bearing edge 9 of the circumference of the support 3. In this way, the tension of the drum head 2 is adjustable while an evenly distributed tension, i.e. uniform tension, over the whole bearing edge 9 and drum head 2 is maintained. Thus, by operating the single actuator 6, the pitch of the percussion instrument 1 may be tuned while simultaneously maintaining uniform tension of the drum head 2 around the bearing edge 9 of the support 3.

Preferably, the inner ring 8 comprises an external screw thread 12 and the outer ring 11 comprises a mating internal screw thread 13. Mating screw threads 12, 13 allow for a very effective and robust adjustment of the tension of the drum head 2.

The pitch P of the screw threads 12, 13 relates to the relative displacement of the abutment 10 relative to the hearing edge 9, and thus also relates, via the tension in the drum head 2, to the pitch of the tone produced by the percussion instrument 1 when it is struck.

The pitch P of the screw thread 12, 13 is preferably in the range of 4-8 mm, preferably in the range of 5-7 mm, and most preferably about 6 mm. It has been found that if a pitch P of 6 mm is combined with a drum head 2, that has a diameter of substantially 20.3 cm (8 inch), the complete tension range of the drum head 2, covering more than an octave in pitch, is available within a relative rotation between the inner ring 8 and outer ring 11 of about 60°. The skilled person will be able to apply this teaching to alternative sires for drum heads 2, such as drumheads 2 having a diameter of about 33 cm (13 inch), and easily find a pitch P and rotation distance that provide adjustment over the complete tension range of the respective drum head 2.

In order to provide a controllable and convenient adjustability of the inner ring 8 and outer ring 11 relative to each other, the tensioning mechanism preferably comprises a gear 14.

Such a gear 14 may comprise a gear rack 15 and a mating pinion 16. In the shown embodiment the pinion 16 comprises a pinion shaft 17 that is engageable with a standard tuning key 18. The transmission ration between the pinion 16 and gear rack 15 provide a lever action, and allow fora controllable fine adjustment of the tension of the drum head 2.

As can be best seen in FIGS. 4 and 6, the gear rack 15 extends over a part of the circumference 7 of the inner ring 3. The gear rack 15 relates to the relative rotation between the inner ring 8 and the outer ring 11, and in relation with the pitch P of the screw threads 12, 13, defines a pitch adjustment range of the percussion instrument 1. The gear rack 15 may extend over an arc length defined by an angle $\alpha$ at a centre 19 in the range of 30°-90°, for example 60°.

The pinion 16 comprises a pinion shaft 17 with an outer rim 20 extending radially outward from the pinion shaft 17 past a pinion tooth 21. The outer rim 20 allows the engagement for the tuning key (or drum key) 18 to be arranged on an upper side of the percussion instrument 1. In this way, the percussion instrument 1 may be easily tuned, even during play.

The percussion instrument 1 shown in FIGS. 1-8 is of a limited height, providing a compact design that may be easily stored and transported, and is also light weight. However, according to a further preferred embodiment, the support 3 is part of a shell 23 that defines a resonance box 24 of the percussion instrument 1. The support 3 may be an integral part with the shell 23 or arranged on a shell 3 of a conventional drum that is retrofit equipped with a tensioning mechanism 5 according to the invention (FIG. 9).

Preferably, at least one of the support 3 and the tensioning, mechanism 5 is 3D-printed, 3D printing, also known as additive manufacturing, provides a number of advantages for a percussion instrument 1 according to the invention. On the one hand, the height of the bearing edge 9 is very accurate and constant if the number of layers of the additive manufacturing is identical for the whole bearing edge 9. Moreover, using 3D manufacturing, on the one hand a very accurate circular shape (in top view) of the bearing edge 9 can be manufactured. On the other hand, the specific shape of the bearing edge 9 (in cross section) may be freely formed in a variety of shapes, thereby providing the opportunity to control the friction between the skin head 2 and the bearing edge 9 and the tonality. Finally, a wall thickness of the support 3 may be varied in longitudinal direction, allowing for acoustic tuning of the resonance box 24 defined by the shell 23 of a percussion instrument 1.

In a preferred embodiment, shown in FIG. 1, at least one of the support 3 and the tensioning mechanism 5 is made from a transparent or semi-transparent material. The percussion instrument 1 may further comprise a light source 25. The light source 25 are preferably integrated in at least one of the support 3 and the outer ring 11.

The percussion instrument 1 may further comprise an extension 26 that extends from the support 3 inward and configured to be arranged on a carrier 27. The carrier 27 may comprise an upright 28 that is arranged on a frame 29 (of which only a part is shown).

Also a microphone 30 may be arranged in the space enclosed by the support 3. The microphone 30 is preferably arranged in at least one of the extension 26 or the carrier 27, concealing it front view. Extension 26 may comprise an opening 31 in which the microphone 30 is arranged.

If a controller 32 is provided, and connected to the light source 25, it may control the light source 25. For example, multiple percussion instruments 1, such as multiple snare drums and a bass drum, may be successively lighted in order to teach a player a new rhythm or song. The controller 32 may obtain feedback if the microphone 30 is also connected to the controller 32.

In the preferred embodiment shown in the Figures, the tensioning mechanism 5 comprises the abutment 10 that is configured to engage the flange 4 of the drum head 2, as well as the mating external screw thread 12 of the inner ring 8 and the internal screw thread 13 of the outer ring 11, and preferably also a gear 14.

The above described embodiment is intended only to illustrate the invention and not to limit in any way the scope of the invention. Accordingly, it should be understood that where features mentioned in the appended claims are followed by reference signs, such signs are included solely for the purpose of enhancing the intelligibility of the claims and are in no way limiting on the scope of the claims. The scope of the invention is defined solely by the following claims.

The invention claimed is:

1. A percussion instrument, comprising:

a drum head arranged on a support with a flange of the drum head extending from the support, wherein the support is an inner ring;

an outer ring comprising an abutment that is configured to engage the flange of the drum head;

wherein the inner ring and the outer ring are concentrically arranged and moveable relative to each other in a longitudinal direction;

a tensioning mechanism, comprising an external screw thread going around on an outer circumference of the inner ring, and an internal screw thread going around on an inner circumference of the outer ring; and a gear, wherein the internal screw thread of the outer ring is arranged between the abutment and the gear.

2. The percussion instrument according to claim 1, wherein the tensioning mechanism has a single actuator configured to simultaneously tune a pitch of the percussion instrument by operating the single actuator and maintain uniform tension of the drum head around a circumference of the support.

3. The percussion instrument according to claim 1, wherein the circumference of the inner ring comprises a bearing edge.

4. The percussion instrument according to claim 1, wherein the abutment is ring shaped.

5. The percussion instrument according to claim 1, wherein the pitch of the screw thread is in the range of 4-8 mm.

6. The percussion instrument according to claim 1, wherein the pitch of the screw thread is in the range of 5-7 mm.

7. The percussion instrument according to claim 1, wherein the pitch of the screw thread is about 6 mm.

8. The percussion instrument according to claim 1, wherein the gear comprises a gear rack and a mating pinion.

9. The percussion instrument according to claim 8, wherein the gear rack extends over a part of a circumference of the inner ring and defines a pitch adjustment range.

10. The percussion instrument according to claim 9, wherein the gear rack extends over an arc length defined by an angle at a centre in the range of 30°-90°.

11. The percussion instrument according to claim 8, wherein the pinion comprises a shaft with an outer rim extending radially outward from the shaft past a pinion tooth.

12. The percussion instrument according to claim 1, wherein the support is part of a shell that defines a resonance box of the percussion instrument.

* * * * *